United States Patent [19]

Sieja

[11] 4,404,940

[45] Sep. 20, 1983

[54] ENGINE SPEED LIMITING CIRCUIT

[75] Inventor: Norman F. Sieja, Toledo, Ohio

[73] Assignee: Allied Corporation, Morristown, N.J.

[21] Appl. No.: 349,394

[22] Filed: Feb. 16, 1982

Related U.S. Application Data

[63] Continuation-in-part of Ser. No. 145,116, Apr. 30, 1980.

[51] Int. Cl.[3] ..... F02P 1/00; F02A 1/00

[52] U.S. Cl. ..... 123/335; 123/599; 123/602

[58] Field of Search ..... 123/335, 334, 599, 625, 123/602

[56] References Cited

U.S. PATENT DOCUMENTS

| | | | |
|---|---|---|---|
| 3,581,720 | 6/1971 | Hemphill et al. | 123/335 |
| 3,976,604 | 7/1976 | Kondo | 123/335 |
| 3,998,198 | 12/1976 | Jereb | 123/599 |
| 4,010,726 | 3/1977 | Kondo et al. | 123/335 |
| 4,171,687 | 10/1979 | Coventry | 123/335 |
| 4,186,711 | 2/1980 | Jöerg | 123/602 |

*Primary Examiner*—Raymond A. Nelli

*Attorney, Agent, or Firm*—James P. DeClercq

[57] ABSTRACT

A speed limiting system particularly suited for use with magneto ignition systems for small internal combustion engines is disclosed. In a first embodiment, shorting transistor (38) is made conductive for a predetermined time after a first trigger pulse from a trigger coil (12) thus preventing subsequent trigger pulses from being effective above a predetermined engine speed. A capacitor (44) is charged by a trigger pulse, and maintains shorting transistor (38) conductive until it is discharged through the shorting transistor (38), subsequent trigger pulses arriving while shorting transistor (38) is conductive recharging the capacitor (44). A diode (42), which also serves to prevent the capacitor (44) from discharging through the trigger coil (12), provides for normal ignition system operation by delaying operating of the shorting transistor (38) until a trigger pulse has become effective upon the gate (34) of a SCR (30). In a second embodiment, the invention is applied to a capacitive discharge ignition system, and in a third embodiment, the invention is applied to an internally triggered ignition system.

1 Claim, 6 Drawing Figures

ENGINE SPEED LIMITING CIRCUIT

CROSS-REFERENCE TO RELATED APPLICATION

This application is a continuation-in-part of an application for Letters Patent Ser. No. 145,116, now allowed filed Apr. 30, 1980.

BACKGROUND OF THE INVENTION

This application relates to speed limiting of internal combustion engines. In particular, the application relates to speed limiting of small internal combustion engines provided with a magneto ignition system.

On some small engine applications, there is a need to limit the maximum speed of the engine to some specific value, either for safety reasons or for limiting the speed of a vehicle on which such an engine is used. This may be necessary to prevent excessive mechanical stresses upon the engine itself, or to accessories attached to the engine, including the magneto flywheel and other such components. One particular application includes hand-held cutting tools powered by such a small engine, where a rotating cutting or drive element may burst when rotated at an excessive speed. In such applications it is common to operate such an engine with its throttle completely open while cutting, for maximum cutting speed and efficiency. However, when the cut is completed, or when the tool is lifted from the work, full-throttle operation may result in dangerous overspeeding.

Speed limiting to preventing such dangerous overspeeding is conventionally accomplished with a mechanical governor operating the throttle of the engine. Such an arrangement is subject to mechanical wear and is easily tampered with, defeating the speed limiting provision. Another known speed limiting method involves interrupting the spark voltage when the engine exceeds a predetermined speed, causing the engine to misfire, and slow down due to its internal friction. The instant invention provides a control circuit for interrupting the ignition of an engine rotating above a predetermined speed which utilizes a minimum number of components, is reliable and repeatable in operation, compact and light in weight, overcoming numerous deficiencies of the prior art.

SUMMARY OF THE INVENTION

The invention involves an ignition system having a semiconductor device, shown as transistor in part controlled by an SCR, and an SCR alone, connected to the primary winding of an ignition coil, and energized and de-energized to allow current to flow in the ignition coil, to produce an ignition impulse. The invention operates by energizing a second semiconductor device to short the trigger pulse to a gate input of a first semiconductor device, shown as an SCR, when engine rotation exceeds a critical speed. Above that critical speed, a capacitor in a network connected to an input of the shorting device, and charged by an ignition trigger pulse, does not have an opportunity to discharge before the next trigger pulse, maintaining the shorting device in a conductive state at the time of the succeeding trigger pulse. Below the critical speed, the capacitor has adequate time to discharge before the following trigger pulse arrives, and the shorting device is in a non-conductive state. The charging current required by the capacitor insures that, below critical speed, the semiconductor device connected across the ignition coil will be de-energized to provide an ignition impulse before the shorting device is energized.

It has been found that this operates to cause a small engine to run at reduced power, a spark plug firing on only one of two successive trigger signals, and that the resulting reduced speed is not accompanied by significant engine roughness or exhaust smoke.

It is an object of the invention to provide a small engine ignition system adapted to limit the speed of the engine by disabling the ignition system when the engine rotates above a predetermined speed. It is an advantage of the invention that such a speed limiting function may be easily implemented, involving a minimum number of additional parts, and adding minimum weight, bulk, and complexity, to an engine incorporating such an ignition system. It is a feature of the invention that the triggering signal for the ignition system is shorted, disabling the ignition system, when a single capacitor has not had an opportunity to discharge before a succeeding trigger pulse occurs.

DESCRIPTION OF THE PREFERRED EMBODIMENT

Figure 1:
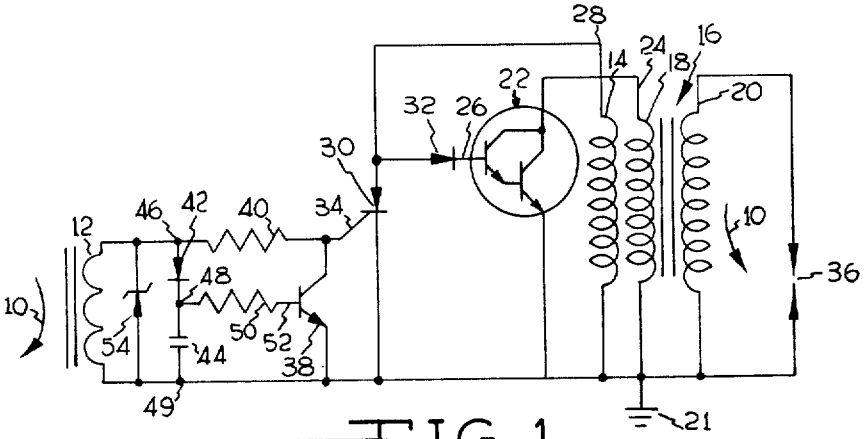
FIG. 1 is a circuit diagram of an ignition system according to the invention.

FIG. 1 shows an ignition system according to the invention. A rotating magnetic field 10 is magnetically coupled to a trigger coil winding 12, a drive coil winding 14, and to an ignition coil 16 having a primary coil widning 18 and secondary coil winding 20. One end of coils 12, 14, 18 and 20 is connected to ground 21. A semiconductive switching means shown as transistor 22 is connected between a terminal 24 of coil 18 and ground 21, and has an input 26. A second semiconductor device 30 is connected between a terminal 28 of coil 14 and ground 21. Terminal 28 is also connected to control terminal or input 26 of semiconductor device 22, for example through third semiconductor device 32. Semiconductor device 30, shown as an SCR, has gate input 34, which is responsive to a signal in trigger coil 12, responsive to rotating magnetic field 10. SCR 30 and device 22 constitute current control means for controlling the flow of current in coil 14 for the ignition system shown in FIG. 1. Semiconductor device 22 is preferably a conventional Darlington transistor.

In an ignition system not provided with a speed limiting circuit according to the invention, the rotation of rotating magnetic field 10 induces a drive voltage in coil 14, which provides control current for transistor 22, rendering it conductive and permitting a build up of magnetic flux in ignition coil 16. Then, as flux in ignition coil 16 reaches its maximum, rotating magnetic field 10 induces a trigger signal in trigger winding 12, which is applied to SCR 30 to place it in a conducting state. When SCR 30 conducts, transistor 22 is de-energized and ceases to conduct. When transistor 22 is de-energized, current ceases to flow through coil 18, and the magnetic flux in ignition coil 16 collapses. The collapse of this flux induces a high voltage in secondary coil 20, which is applied to a spark plug 36 to operate the engine. The latching characteristic of SCR 30 allows transistor 22 to remain non-conductive until rotating magnetic field 10 has ceased to induce voltage in drive winding 14 and ignition coil 16. According to the invention, a threshold shorting device shown as transistor 38 is connected between gate input 34 of SCR 30 and ground 21. A resistive means, here shown as resistor 40 is interposed between trigger coil 12 and input 34. A rectifying diode means here shown as diode 42 and capacitive means, here shown as capacitor 44 are placed in series, and connected across trigger coil 12, diode 42 having a first terminal 46 connected to coil 12, and a second terminal connected to junction 48, capacitor 44 having a terminal connected to junction 48, and a second terminal 49 connected to ground 21. A resistive means, here shown as resistor 50, is interposed between junction 48 and the control terminal 52 of threshold shorting or switching device 38. A voltage regulating means shown as zener diode 54 may be connected across trigger coil 12.

In operation, during each revolution of rotating magnetic field 10, a positive voltage pulse is generated in trigger coil 12, which appears at the gate input 34 of SCR 30 and causes it to change from a non-conducting state to a conducting state. This action controls transistor 22 to cause a spark to appear at spark plug 36. A triggering pulse is necessary to produce each spark. As will be apparent, the positive trigger pulse generated by trigger winding 12 cannot, as applied to gate input 34 of SCR 30, exceed a value greater than approximately 0.7 volts due to the inherent characteristics of SCR 30. Register 40, interposed between gate input 34 and trigger coil 12, allows the voltage across trigger winding 12 to rise to a much higher value while the voltage at gate input 34 of SCR 30 remains at essentially 0.7 volts. The addition of a resistor 40 has no adverse effect on the normal operation of the ignition system because the voltage required by gate input 34 of SCR 30 is substantially lower than the voltage available from trigger coil 12. The larger voltage now appearing across trigger winding 12 is used to charge capacitor 44 through diode 42. Diode 42 serves to insure that the capacitor 44 is charged only in a positive direction and to insure that, once charged, it cannot discharge through trigger winding 12.

Capacitor 44 charges essentially to the peak value of the positive portion of the trigger pulse generated in trigger coil 12. When the voltage across capacitor 44 exceeds the threshold voltage, about 0.7 volts, of the threshold shorting device shown as transistor 38, capacitor 44 will begin to discharge through resistor 50, and input 52 of the threshold shorting device shown as transistor 38, forcing transistor 38 to a conductive state, and shorting gate input 34 of SCR 30 to ground 21. The predetermined time for capacitor 44 to discharge to a voltage below which transistor 38 will be rendered non-conductive is determined by the value of capacitor 44, the value of resistor 50, and the magnitude of the voltage pulse from trigger coil 12, which is, if not otherwise limited, proportional to the speed of rotation of rotating magnetic field 10. In the illustrated embodiment, a voltage regulating means shown as zener diode 54 is connected across trigger coil 12 to regulate the amplitude of voltage pulses from trigger coil 12, and reduce the variation in critical speed which may be obtained in ignition systems according to the invention.

As will be apparent, under normal operation SCR 30 must be energized before transistor 38 is energized. Diode means such as diode 42 has a forward voltage drop, typically near 0.7 volts, here the same as the input characteristic of gate input 34 of SCR 30. As illustrated, the voltage at terminal 46 of diode 42 must be approximately twice the voltage required to energized SCR 30, to energize transistor 38. Therefore, as the voltage across trigger coil 12 rises with the rotation of rotating magnetic field 10, SCR 30 will be energized prior in time.

However, should engine rotation, and hence the rotation of rotating magnetic field 10, exceed a predetermined rate, capacitor 44 will not yet have discharged, and transistor 38 will still be in a conductive state at the time of the next trigger signal generated in trigger coil 12. Under these conditions, an ignition pulse will be prevented by the threshold shorting device shown as transistor 38 by preventing a trigger signal from being effective to actuate the current control means shown as SCR 30 and transistor 22.

Figure 2:
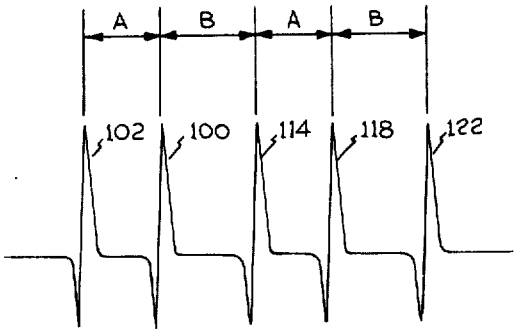
FIG. 2 is a diagram showing the ignition trigger voltage obtained using the ignition system shown in FIG. 1.
Figure 3:
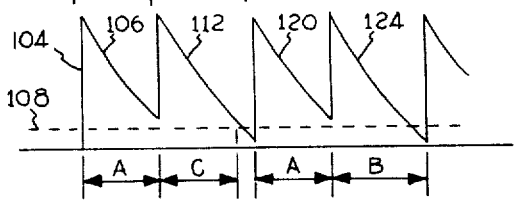
FIG. 3 is an illustration of the voltage across a capacitor of the ignition system shown in FIG. 1.
Figure 4:
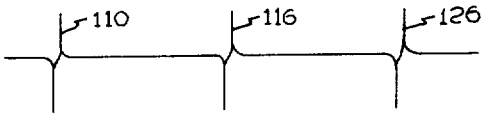
FIG. 4 is an illustration at the waveform applied to a triggering device of the ignition system shown in FIG. 1 when engine speed exceeds a predetermined limit.

Turning now to FIGS. 2, 3 and 4, a trigger signal pulse 100 is shown, occuring a time interval A, after a trigger signal pulse 102, time interval A being indicative of the speed of rotation of rotating magnetic field 10 above the desired critical limit. As shown in FIG. 3, an illustration of the voltage 104 across capacitor 44, capacitor 44 has been charged in response to trigger signal pulse 102, and decays along slope 106. However, as shown in FIGS. 2 and 3, at the time of arrival of succeeding trigger signal pulse 100, voltage 104 has not returned to threshold 108 of input 52 of transistor 38, capacitor 44 requiring a time interval C to discharge to threshold 108, transistor 38 remaining conductive and preventing an ignition pulse. Comparing FIGS. 2, 3 and 4, an ignition pulse 110 was produced in response to trigger signal pulse 102, but, transistor 38 being conductive, no ignition pulse is generated in response to trigger signal pulse 100. However, trigger signal pulse 100 recharges capacitor 44, which begins decaying along slope 112. Comapring FIGS. 2, 3 and 4, it will be noted that an ignition pulse 110 was produced in response to trigger signal pulse 102, but that no such ignition pulse was produced in response to trigger signal pulse 100.

The associated engine, having misfired, will start to slow down due to forces in the engine and its load. As shown, the engine speed decreases to a speed below critical speed, a trigger signal pulse 141 being produced at time interval B after tirgger signal pulse 100, which is indicative of an engine speed below critical speed. Capacitor 42 having discharged along slope 112 to a value below threshold 108, an ignition pulse 116 will be produced. If, for instant, the overspeeding condition was as a result of removing the load from a cutting tool, ignition pulse 116 will result in the engine speed increasing beyond critical speed, a trigger signal pulse 118 being generated at a time interval A, after trigger signal pulse 114 which is indicative of engine speed above critical speed. Capacitor means 44, having been charged in response to trigger signal pulse 114, and decaying along slope 120, will not have reached threshold 108 before trigger signal pulse 118 is produced, threshold device 38 remaining conductive, and no ignition pulse being generated. As before, this will cause the engine to slow down, the next trigger signal pulse 122 arriving at time interval B, after trigger signal pulse 118, indicative of engine speed below critical speed, and the voltage across capacitor means 44, decaying along slope 124, reaches threshold 108 prior to the arrival of trigger signal pulse 122, and produces ignition pulse 126. This sequence will repeat, with the rate of production of ignition pulses such as 110, 116 and 126, being determined by the load upon the engine and the throttle setting.

Figure 5:
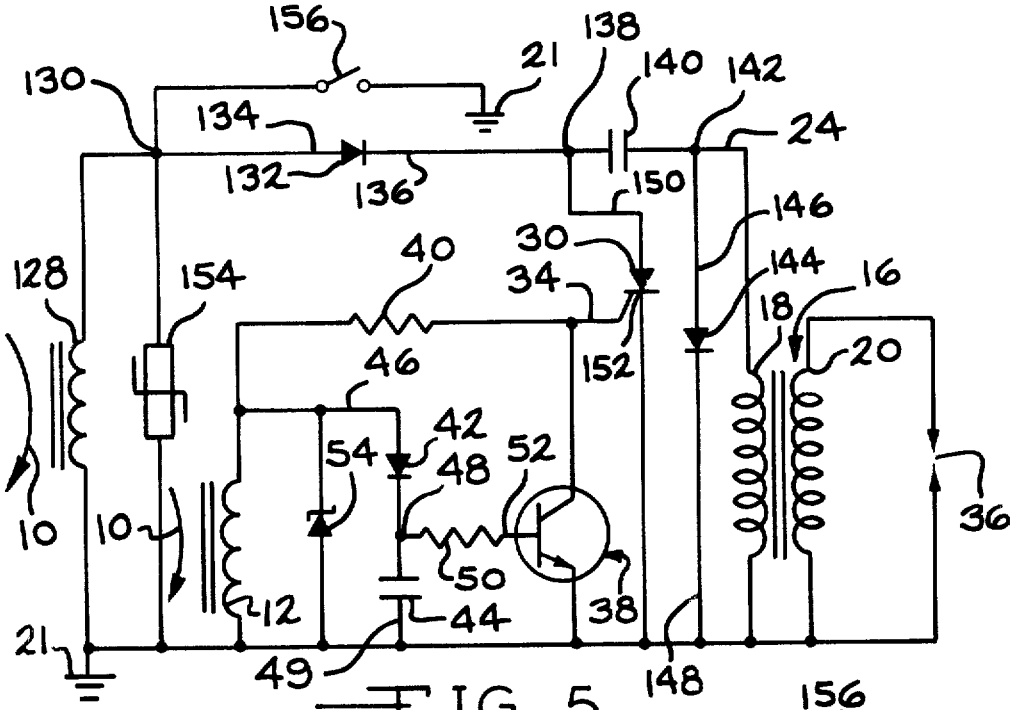
FIG. 5 is a circuit diagram of a second embodiment of an ignition system according to the invention.

FIG. 5 shows a second embodiment of the invention, wherein the speed limiting circuit of the invention is applied to an ignition system of the self-powered capacitive discharge type. Since the speed limiting feature of the invention operates in the same manner regardless of the type of ignition system used, common reference numerals will be used to identify corresponding parts of corresponding functions. As shown in FIG. 5, a generating winding 128 is connected between ground 21 and terminal 130. A diode 132 having an anode terminal 134 and a cathode terminal 136, has anode terminal 134 connected to terminal 130, and cathode terminal 136 connected to a terminal 138. A capacitor 140 is connected between terminal 138 and a terminal 142. A diode 144, having an anode terminal 146 and a cathode terminal 148, has anode terminal 146 connected to terminal 142, and cathode terminal 148 connected to ground 21. Terminal 24 of primary coil winding 18 is also connected to terminal 142. An SCR 30 includes an anode terminal 150 connected to terminal 138, and a cathode terminal 152 connected to ground 21.

A bidirectional voltage limiting device 154 is preferably connected between terminal 130 and ground 21, to limit the magnitude of the voltage induced in generating winding 128, and a shutoff switch 156 may be interposed between terminal 130 and ground 21 to bypass the voltage generated by generating winding 128, to stop the engine associated with spark plug 36.

The operation of the circuit shown in FIG. 5 differs from that shown in FIG. 1 in that SCR 30 directly controls primary coil winding 18 of ignition coil 16, rather than controlling it through an intermediate device. In operation of the basic circuit, rotating magnetic field 10 induces a voltage in generating winding 128, which causes a current flow through diode 132, charging capacitor 140 through primary coil winding 18. When rotating magnetic field 10 subsequently energizes trigger coil winding 12, mechanically offset from generating winding 128, a trigger signal is applied to gate input 34 of SCR 30 through resistor 40, causing it to become conductive. Capacitor 140 then discharges, current flowing from terminal 138, through SCR 30, ground 21, primary coil winding 18, and returning to terminal 142. This sudden flow of current through primary coil winding 18 induces a high voltage is secondary coil winding 20, which is applied to the spark plug 36.

In accordance with the invention, a threshold shorting device shown as transistor 38 is connected between gate input 34 and ground 21, with its control terminal 52 connected to junction 48 through resistor 50. A diode 42 has a first terminal 46 connected to coil 12, and a second terminal connected to junction 48, and a capacitor 44 has a terminal connected to junction 48 and a second terminal 49 connected to ground 21. A voltage regulating means shown as zener diode 54 may be connected across trigger coil 12, if desired.

In operation, during each rotation of rotating magnetic field 10, a positive voltage pulse is generated in trigger coil 12, which appears at the gate input 34 of SCR 30 and causes it to change from a non-conducting state to a conducting state. This action discharges capacitor 140 as described above. As desired in connection with FIG. 1, additional resistor 40 allows the voltage across trigger winding 12 to rise to a much higher value than the voltage which may appear at gate input 34 of SCR 30. The larger voltage now appearing across trigger winding 12 is used to charge capacitor 44 through diode 42. Diode 42 serves to insure that capacitor 44 is charged only in a positive direction and to insure that, once charaged, it cannot discharge through trigger winding 12. As described above, capacitor 44 charges essentially to the peak value of the positive portion of the trigger pulse generated in trigger coil 12. When the voltage across capacitor 44 exceeds the threshold voltage of the threshold device shown as transistor 38, capacitor 44 will begin to discharge through input 52, shorting gate input 34 of SCR 30 to ground 21. As with the circuit shown in FIG. 1, the time for capacitor 44 to discharge to a voltage below the threshold of transistor 38 is determined by the value of capacitor 44, the value of resistor 50, and the magnitude of the voltage pulse from trigger coil 12, preferably limited by zener diode 54. Thus, in normal operation, transistor 38 will become conductive after a trigger signal has been applied to gate input 34, and will remain conductive for a predetermined time. Component values are selected so that the predetermined time is related to the desired maximum engine speed. If the engine exceeds this speed, the transistor 38 will still be conductive at the time rotating magnetic field 10 next energizes trigger coil winding 12, and the resulting trigger signal will be ineffective to actuate SCR 30.

Figure 6:
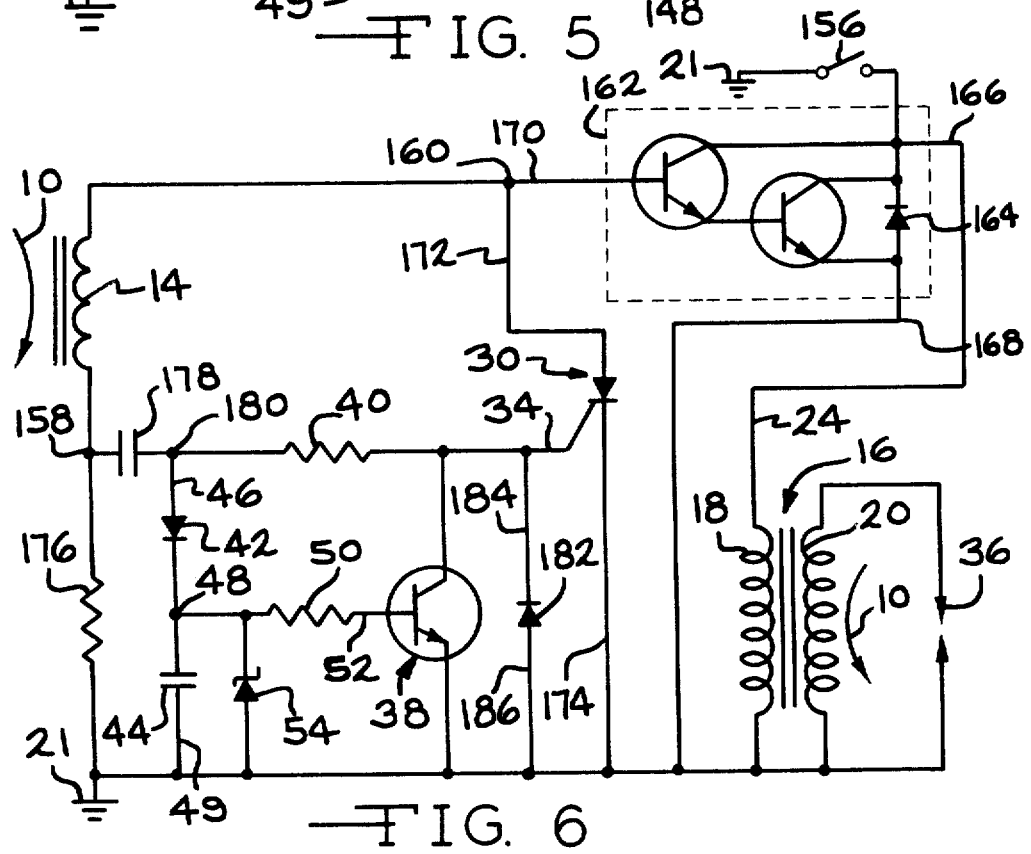
FIG. 6 is a circuit diagram of a third embodiment of an ignition system according to the invention.

Turning now to FIG. 6, a third embodiment of an ignition system incorporating the invention is shown. Here, drive coil winding 14 has a first terminal connected to junction 158 and a second terminal connected to junction 160. A conventional Darlington transistor 162, including an internal protective diode 164 connected between its controlled terminals 166 and 168, has an input or control terminal 170, shown as a base terminal of Darlington transistor 162, is connected to junction 160. Controlled terminal 166 is connected to terminal 24 of primary coil winding 18, which has its opposite terminal connected to ground 21. Controlled terminal 168 is directly connected to ground 21. Also connected to junction 160 is anode terminal 172 of an SCR shown as SCR 30, which includes a cathode terminal 174 connected to ground 21. SCR 30 and transistor 162 constitute the current control means for winding 18 in this figure.

A current sensing resistor 176 is connected between junction 158 and ground 21, and a capacitor 178 is connected between junction 158 and junction 180. A resistor 40 is connected between junction 180 and gate input 34 of SCR 30. A diode 182 has its cathode terminal 184 connected to gate input 34, and an anode terminal 186 connected to ground 21.

In FIG. 6, resistor 176, capacitor 178 and diode 182 serve as a trigger means, in place of the trigger coil winding shown in the previous two embodiments, for providing a trigger signal to a current control means, shown as SCR 30 and transistor 22 in FIG. 1, SCR 30 in FIG. 5, and SCR 30 and transistor 162 in FIG. 6.

Similar to the circuits shown for the preceding two embodiments of the invention, diode 42 has a first terminal 46 connected to a junction shown as junction 180 to which resistor 40 is connected, and a second terminal connected to junction 48. A capacitor 44 has a first terminal connected to junction 48 and a second terminal 49 connected to ground 21. A zener diode 54 interconnects junction 48 and ground 21. A resistor 50 is shown electrically connected between junction 48 and control terminal 52 of the threshold shorting device shown as transistor 38, which in turn is connected between gate input 34 and ground 21, for shorting gate input 34 to ground 21.

In operation, rotating magnetic field 10, which affects both ignition coil 16 and drive coil winding 14, induces a current in drive coil winding 14, which current, using conventional terminology, flows into control terminal 170 of transistor 162, causing it to become conductive between terminals 166 and 168, thus allowing a current to flow in primary coil winding 18 of ignition coil 16 in response to rotating magnetic field 10. The current flowing into control terminal 170 of transistor 162 also flows through current sensing resistor 176, and causes a voltage which is negative with respect to ground 21 to appear at junction 158. The charging current for capacitor 178 at this time flows from ground 21 through diode 182 and resistor 40.

As is known, when a rotating magnetic field such as magnetic field 10 departs from the vicinity of a winding such as drive coil winding 14, a voltage of opposite polarity is induced, resulting in a current of opposite polarity. As a result, a current-induced voltage which is positive with respect to ground 21 will appear at junction 158, which adds to the charge present on capacitor 178 to produce a higher positive voltage at junction 180, which is coupled through resistor 40 to gate input 34, causing SCR 30 to become conductive, connecting control terminal 170 of transistor 162 to ground, causing it to become non-conductive, and blocking the flow of current through primary coil winding 18. This cessation of current causes a high voltage to appear on secondary coil winding 20, to operate spark plug 36.

The voltage appearing at junction 180, and augmented by the charge upon capacitor 178, causes a current to flow through diode 42 to charge capacitor 44. At some time subsequent to the initial activation of SCR 30, the voltage appearing at junction 48 and coupled to control terminal 52 through resistor 50 will reach the threshold value of transistor 38, causing it to become conductive. The subsequent discharge of capacitor 44 through control terminal 54 of transistor 38 will cause transistor 38 to remain in conductive state for a predetermined period of time. If the speed of an engine operated by spark plug 36 is less than a predetermined maximum desirable speed, capacitor 44 will have discharged before rotating magnetic field 10 appears to start the generation of another ignition pulse. However, if engine speed is excessive, transistor 38 will still be conductive at the time of the next desired ignition pulse, and will prevent the generation of the ignition pulse by preventing the activation of SCR 30, while recharging capacitor 44. The resulting loss of power will cause the engine to slow, so that, at the time of a subsequent desired ignition pulse, capacitor 44 will be discharged, and spark plug 36 will be activated.

Thus, as will be apparent, a speed limiting circuit according to the invention may be applied to several different types of ignition systems, and numerous other variations and modifications of the disclosed invention, including substitutions of components and combining separate disclosed components into a single physical component, will be apparent to one skilled in the art, and may be made without departing from the spirit and scope of the invention.

I claim:

1. A speed limiting circuit for an ignition system including an ignition coil including a primary coil winding and having a current control means for controlling the flow of a current through the primary coil winding to cause an ignition impulse in a secondary coil winding of said ignition coil, and trigger means operatively connected to the current control means for providing a trigger signal for controlling the current control means, comprising:

circuit means operatively interposed between said trigger means and said current control means;

said circuit means including threshold shorting means for at least intermittently shorting said trigger signal to prevent said trigger signal from being effective to actuate said current control device;

a resistor being operatively interposed between said trigger means and a first control terminal of said current control means;

said threshold shorting device having first and second controlled terminals operatively connected to said first control terminal of said current control means and to an electrical ground respectively for preventing said trigger signal from affecting said first control terminal;

said threshold shorting device having a second control terminal resistively connected to a first terminal of a diode means and a first terminal of a capacitor means, a second terminal of said diode means being electrically connected to said trigger means and a second terminal of said capacitor means being electrically connected to said electrical ground;

said trigger signal charging said capacitor means through said diode means, said capacitor means discharging through said second control terminal to render said threshold shorting device conductive for a first predetermined time period while a voltage of said capacitor means exceeds a threshold voltage of said threshold shorting device;

a trigger signal caused by said trigger means at a second predetermined time before a termination of said first predetermined time period being ineffective to actuate said current control means.

* * * * *